United States Patent [19]

Eberly, Jr.

[11] 3,976,562

[45] Aug. 24, 1976

[54] HYDRODESULFURIZATION WITH ALCOHOL ADDITION

[75] Inventor: Paul E. Eberly, Jr., Baton Rouge, La.

[73] Assignee: Exxon Research and Engineering Company, Linden, N.J.

[22] Filed: June 17, 1975

[21] Appl. No.: 587,540

[52] U.S. Cl. ..... 208/216

[51] Int. Cl.[2] ..... C10G 23/02

[58] Field of Search ..... 208/209, 213, 215, 216, 208/217, 240

[56] References Cited

UNITED STATES PATENTS

| | | | |
|---|---|---|---|
| 1,899,042 | 2/1933 | Malisoff | 208/240 |
| 2,792,332 | 5/1957 | Hutchings | 208/240 |
| 3,846,288 | 11/1974 | Chun et al. | 208/240 |

*Primary Examiner*—G. J. Crasanakis

*Attorney, Agent, or Firm*—M. L. Gibbons

[57] ABSTRACT

A hydrodesulfurization process is conducted in the presence of an added C1 to C4 alcohol, preferably methanol, or an alcohol-water mixture. The addition of alcohol improves the activity of the catalyst and results in a net production of heat which can be utilized to vaporize the incoming alcohol.

15 Claims, 1 Drawing Figure

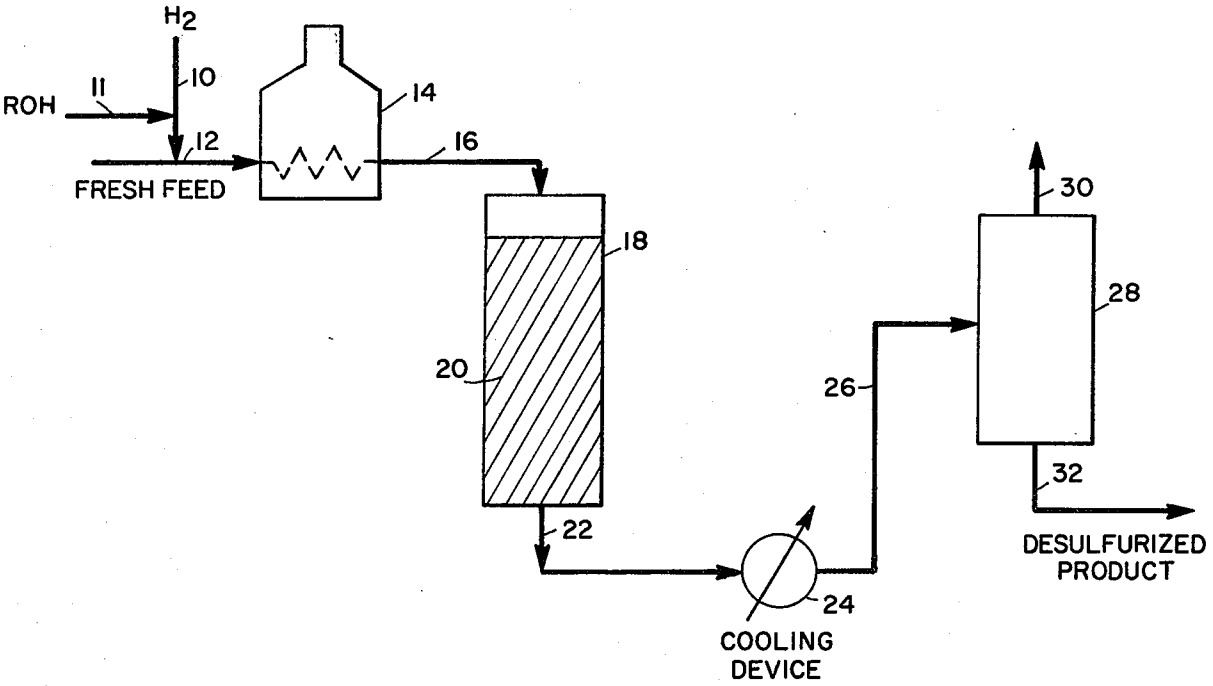
ROH
11
H2
10
12
FRESH FEED
14
16
18
20
22
COOLING DEVICE
24
26
28
30
32
DESULFURIZED PRODUCT

HYDRODESULFURIZATION WITH ALCOHOL ADDITION

BACKGROUND OF THE INVENTION

1. Field of the Invention

The present invention relates to a process for the desulfurization of sulfur-containing hydrocarbon oils. More particularly, it relates to hydrodesulfurization process wherein the hydrogen-containing treating gas comprises an added C1 to C4 alcohol.

2. Description of the Prior Art

Hydrodesulfurization processes in which water as a liquid or as a vapor is added to the hydrodesulfurization reaction zone are known, see for example U.S. Pat. Nos. 3,501,396; 3,753,894, and 3,720,602. Water addition to a hydrodesulfurization process can be costly due to the heat required to vaporize the water to steam and to heat it to reaction temperature. It is also difficult to vaporize large quantities of water smoothly without causing undue vibrations and pressure shock waves in the reaction vessel.

It has now been found that the addition of a C1 to C4 alcohol, preferably methanol, to the hydrodesulfurization process will overcome many of the difficulties involved in $H_2O$ addition. Methanol, for example, has a lower surface tension and is more soluble than water in the hydrocarbon feed, and has a lower heat of vaporization.

SUMMARY OF THE INVENTION

In accordance with the invention, there is provided a hydrodesulfurization process which comprises: contacting, in a reaction zone, at hydrodesulfurization conditions, a sulfur-containing hydrocarbon oil feed with a hydrodesulfurizaion catalyst and a hydrogen-containing treating gas comprising a C1 to C4 alcohol.

BRIEF DESCRIPTION OF THE DRAWING

The FIGURE is a schematic flow plan of one embodiment of the invention.

DESCRIPTION OF THE PREFERRED EMBODIMENT

The preferred embodiment will be described with reference to the accompanying FIGURE. Referring to the FIGURE, a hydrogen-containing treating gas stream 10 is combined with a sulfur-containing hydrocarbon stream 12 and passed through furnace 14 and introduced via line 16 into hydrodesulfurization reaction vessel 18. Suitable sulfur-containing hydrocarbon oil feeds include feeds having up to 8 weight percent sulfur, preferably at least 0.25 weight percent sulfur, more preferably between 2 and 8 weight percent sulfur. The process is designed to treat hydrocarbon feeds containing up to 1,000 weight ppm total metal content (i.e. Ni, V, Fe) without pretreatment. When the total metallic content exceeds 1,000 weight ppm, it may be necessary to employ a conventional metals removal step or to use a guard chamber. By way of example, suitable hydrocarbon oil feeds include naphthas, whole petroleum crude oils, topped or reduced petroleum crude oils; heavy petroleum distillates such as atmospheric gas oil, vacuum gas oil, coker gas oil, visbreaker gas oil; petroleum atmospheric residua; petroleum vacuum residua; asphaltenes; cycle oil; pitch, asphalt and bitumen derived from coal, tar sand or shale; naturally occurring tars as well as tars resulting from petroleum refining process; shale oils; tar sand oils; and mixtures thereof. The hydrodesulfurization process is particularly suited to treat heavy petroleum distillates such as gas oils. Typically, the hydrogen rich stream contains 60 volume percent hydrogen, the remainder being light hydrocarbon gases such as $CH_4$ or $H_2S$ or some $NH_3$ or mixtures thereof.

In reaction vessel 18, is maintained a hydrodesulfurization catalyst in fixed bed 20. Instead of maintaining the catalyst in a fixed bed, the catalyst can be maintained in a moving, fluid or ebullient bed.

The catalyst maintained in bed 20 may be any conventional hydrodesulfurization catalyst. A suitable hydrodesulfurization catalyst comprises a hydrogenation component comprising at least one metal, metal oxide or metal sulfide of a Group VIB element of the Periodic Table and at least one metal, metal oxide or metal sulfide of the non-noble metals of Group VIII of the Periodic Table on a support. The Periodic Table referred to herein is in accordance with the *Handbook of Chemistry and Physics* published by the Chemical Rubber Publishing Company, Cleveland, Ohio, 45th Edition, 1964.

Suitable supports include aluminum phosphate, boron phosphate, refractory oxides such as alumina, silica-alumina, zirconia, magnesia, boria, strontia, hafnia and mixtures thereof. The preferred refractory oxide is an alumina-containing support, preferably an alumina-containing carrier comprising from about 1 to about 6 weight percent silica. Such a catalytic support which additionally comprises a hydrogenation component may be prepared as indicated in U.S. Pat. No. 3,509,044, the teachings of which are hereby incorporated by reference. A preferred catalyst comprises a cobalt or a nickel component in admixture with a molybdenum or tungsten component composited with an alumina support containing from about 1 to about 6 weight percent silica.

A C1 to C4 alcohol, preferably methanol, is introduced into the hydrogen-rich stream via line 11. The alcohol may also be introduced into the hydrocarbon feed line 12 as a liquid which is converted to vapor in the furnace and in the reaction vessel. Alternatively, the alcohol may be introduced directly as liquid or vapor into reaction vessel 18. Whatever the manner of introduction, a sufficient amount of alcohol is introduced to provide in the reaction vessel from about 1 to about 30 volume percent, preferably from about 5 to about 20 volume percent of the hydrogen-containing treating gas present in the hydrodesulfurization vessel. If desired, instead of alcohol alone, a mixture of alcohol and $H_2O$ may be used. When a mixture of alcohol and $H_2O$ is added to the hydrodesulfurization process, sufficient alcohol should be used to provide from about 2 to about 10 volume percent of the entire gas treating mixture present in the hydrodesulfurization vessel. Besides improving the catalytic activity, the addition of the given alcohol to the hydrodesulfurization zone results in heat release due to the exothermic reaction of at least a portion of the alcohol with the hydrogen treating gas.

For example, when methanol is used as the added alcohol, the heat balance compared to the addition of water is as follows:

TABLE I

| | $CH_3OH$ | $H_2O$ |
|---|---|---|
| ΔHv, kcal./mole | + 8.43 | 10.48 |
| Heat required to raise gas from 77°–650°F. | + 6.04 | 3.63 |
| ΔH of reaction, kcal./mole | −28.00 | — |
| Total heat required, kcal./mole | −13.53 | +14.11 |

Consequently, on a molar basis, $H_2O$ addition requires a heat expenditure of 14 kcal./mole whereas $CH_3OH$ addition produces 13.53 kcal./mole. This heat can be utilized to vaporize the incoming methanol stream.

The hydrodesulfization process is operated at a hydrogen partial pressure ranging from about 50 to about 4000 pounds per square inch gauge (psig), preferably from about 200 to about 2500 psig. Suitable hydrocarbon feed liquid hourly space velocities (defined as the volume of hydrocarbon feed per hour per volume of catalyst) include a space velocity ranging from about 0.3 to about 10 volumes of hydrocarbon feed per hour per volume of catalyst, preferably from about 0.5 to about 2 volumes of hydrocarbon feed per hour per volume of catalyst. Suitable hydrogen flow rates in the reaction zone include from about 100 to about 10,000 standard cubic feet of hydrogen per barrel of hydrocarbon feed, preferably from about 200 to about 5000 SCF/B; a hydrodesulfurization reaction zone temperature ranging from about 400° to about 900°F., preferably from about 650° to about 850°F. Suitable reaction zone total pressures include a pressure ranging from about 50 to about 4000 psig, preferably from about 100 to about 4000 psig.

Returning to reaction vessel 18, under the given operating conditions, a sulfur-containing hydrocarbon oil feed contacts the hydrogen-containing gas which comprises the added C1 to C4 alcohol and the hydrodesulfurization catalyst. The effluent of reaction vessel 20 is removed via line 22 and passed to a cooling device 24. The cooled effluent via line 26 is passed to a separator 28. A vaporous effluent comprising hydrogen, alcohol, some $H_2O$, $H_2S$ and light ends is removed from the separator via line 30. This effluent, after purification and removal of $H_2S$ by conventional means, may be recycled to the incoming fresh feed line 12. A desulfurized product, that is, a hydrocarbon product having a lower sulfur content than the hydrocarbon feed is removed from separator 28 via line 32.

The following example is presented to illustrate the invention.

EXAMPLE

A Safaniya vacuum gas oil was hydrodesulfurized at 650°F., 640 psig and at a space velocity of 2.78 volumes of oil per hour per volume of catalyst. The catalyst utilized had the composition given in Table II.

TABLE II

| CATALYST COMPOSITION | |
|---|---|
| Constituents | Amounts |
| CoO | 3.7 wt. % |
| $MoO_3$ | 13.0 wt. % |
| $SiO_2$ | 1.5 wt. % |
| $Al_2O_3$ | 81.8 wt. % |

The tests were made with a treating gas containing hydrogen alone, methanol added to the hydrogen and water added to hydrogen. Results of the tests are given in Table III.

TABLE III

Hydrodesulfurization of Safaniya Vacuum Gas Oil at 650°F., 640 Psig and 2.78 V/V/Hr.

| Treat Gas Composition | 100% $H_2$ | 9.8% $CH_3OH$ in $H_2$ | 12.0% $H_2O$ in $H_2$ |
|---|---|---|---|
| SCF $H_2$/B | 3239 | 3062 | 5936 |
| % Hydrodesulfurization | 68.2 | 75.9 | 77.6 |
| $k_s$, hr.$^{-1}$ | 1.97 | 2.89 | 2.91 |

The reaction rate constant was evaluated from the following equation:

$$k_s = \left(\frac{1}{S_p^{0.5}} - \frac{1}{S_f^{0.5}}\right) \frac{V/V/\mathrm{Hr}}{0.5} \frac{529}{P_{H_2}} \left(\frac{3000}{\mathrm{SCFH_2}/B}\right)^{0.223}$$

where $S_p$ = wt. % S in product $S_f$ = wt. % S in feed $P_{H_2}$ = press. of $H_2$ (psia)

Methanol addition resulted in over a 50% increase in catalytic activity ($k_s$). This is equivalent to an activity increase which results from the addition of 12 percent $H_2O$. Since the addition of methanol to the hydrodesulfurization process produces rather than consumes heat, savings in costs would be expected by lowering the amount of external heat required for vaporization and also by improvements in ease of operation.

What is claimed is:

1. A hydrodesulfurization process which comprises: contacting, in a reaction zone, at hydrodesulfurization conditions, a sulfur-containing hydrocarbon oil feed with a hydrodesulfurization catalyst and a hydrogen-containing treating gas which includes a C1 to C4 alcohol.

2. The process of claim 1 wherein said alcohol comprises from about 1 to about 30 volume percent of said hydrogen-containing treating gas.

3. The process of claim 1 wherein said alcohol comprises from about 5 to about 20 volume percent of said hydrogen-containing treating gas.

4. The process of claim 1 wherein said hydrogen-containing treating gas additionally includes added $H_2O$.

5. The process of claim 4 wherein said alcohol comprises from about 2 to about 10 volume percent of said hydrogen-containing treating gas.

6. The process of claim 1 wherein said alcohol is methanol.

7. The process of claim 1 wherein said hydrodesulfurization conditions include a temperature ranging from about 400° to about 900°F. and a total pressure ranging from about 50 to about 4000 psig.

8. The process of claim 1 wherein the partial pressure of said hydrogen in said reaction zone is at least 50 psig.

9. The process of claim 1 wherein the hydrogen flow rate in said reaction zone ranges from about 100 standard cubic feet of hydrogen per barrel of hydrocarbon oil to about 10,000 standard cubic feet of hydrogen per barrel of hydrocarbon oil.

10. The process of claim 1 wherein said hydrocarbon oil feed has a liquid hourly space velocity of from about 0.3 to about 10 volumes of hydrocarbon oil per hour per volume of catalyst.

11. The process of claim 1 wherein said hydrodesulfurization catalyst comprises a hydrogenaton component comprising at least one metal, metal oxide or metal sulfide of a Group VIB element and at least one metal, metal oxide or metal sulfide of the non-noble metals of Group VIII and a support selected from the group consisting of alumina, silica-alumina, zirconia, magnesia, boria, strontia, hafnia and mixtures thereof.

12. The process of claim 1 wherein said hydrodesulfurization catalyst comprises a cobalt or nickel component in admixture with a molybdenum or a tungsten component composited with an alumina support.

13. The process of claim 12 wherein said support additionally comprises from about 1 to about 6 weight percent silica (based on the weight of the support).

14. A hydrodesulfurization process which comprises: contacting, in a reaction zone, at a temperature raning from about 400° to about 900°F and a total pressure ranging from about 50 to about 4000 psig, a sulfur-containing hydrocarbon oil feed with a hydro-desulfurization catalyst and a hydrogen-containing treating gas including a C1 to C4 alcohol, the partial pressure of said hydrogen in said reaction zone being at least 50 psig and said alcohol comprising from about 1 to about 30 volume percent of said hydrogen-containing treating gas.

15. The process of claim 14 wherein said alcohol is methanol.

* * * * *